US006039307A

United States Patent [19]

De Zen

[11] Patent Number: 6,039,307

[45] Date of Patent: Mar. 21, 2000

[54] PLASTIC FENCING AND COMPONENTS THEREFOR

[76] Inventor: Vic De Zen, 300 Greenbrook Drive, Woodbridge, Ontario, Canada, L4L 1A6

[21] Appl. No.: 08/984,978

[22] Filed: Dec. 4, 1997

[30] Foreign Application Priority Data

Dec. 10, 1996 [CA] Canada ..... 2192504

[51] Int. Cl.[7] ..... E04H 17/14

[52] U.S. Cl. ..... 256/19; 256/65; 256/66

[58] Field of Search ..... 256/19, 59, 65, 256/22, 24, 1, 21, 66, 67, 69, 70

[56] References Cited

U.S. PATENT DOCUMENTS 3,915,434 10/1975 Lister ..... 256/59
4,194,338 3/1980 Trafton ..... 256/65 X
4,809,955 3/1989 Veilleux ..... 256/19 X
4,923,176 5/1990 Heinz ..... 256/65
5,255,897 10/1993 Pepper ..... 256/66 X
5,421,556 6/1995 Dodge et al. ..... 256/19
5,584,468 12/1996 Meglino et al. ..... 256/34
5,626,331 5/1997 Erwin ..... 256/19 X
5,695,174 12/1997 Tsai ..... 256/19 X
5,788,224 8/1998 Platt ..... 256/19 X

*Primary Examiner*—Lynne H. Browne
*Assistant Examiner*—David E. Bochna

[57] ABSTRACT

A plastic fence in which the connection between the rails and posts are concealed and provide for a rail length adjustment so that the rails can be attached after the posts have been erected. Further the connections between the fence slats and rails are concealed and posts having a hexagonal cross-section are provided.

15 Claims, 11 Drawing Sheets

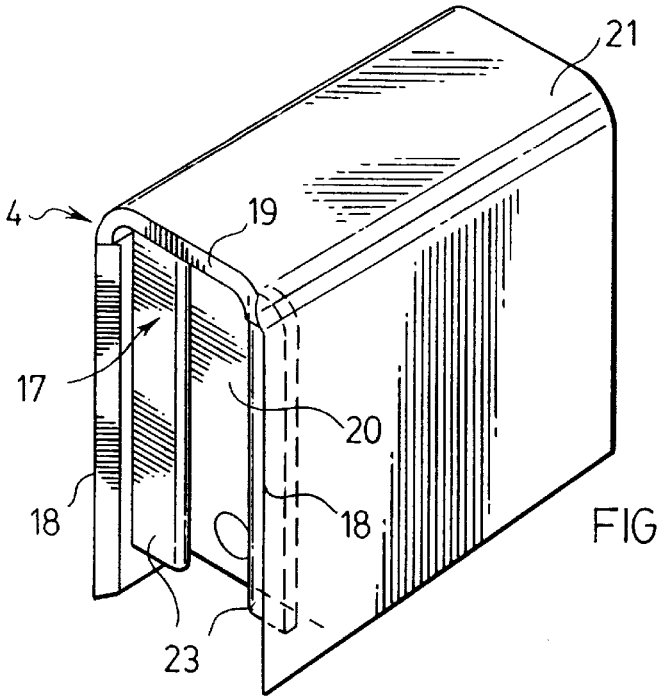
FIG. 4.
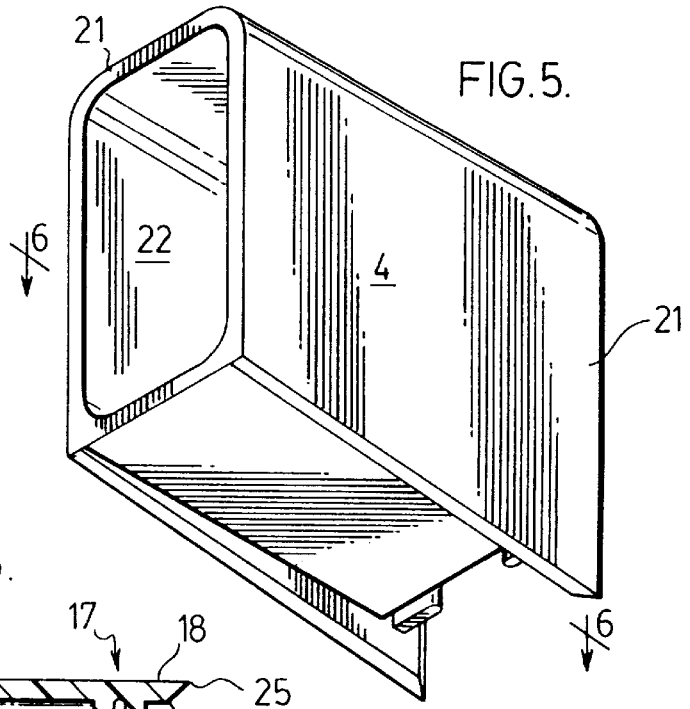
FIG. 5.
FIG. 6.
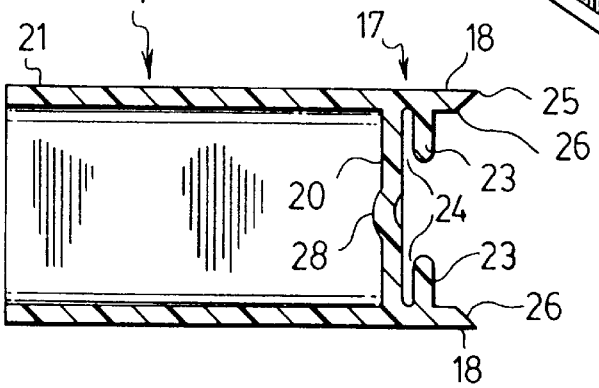

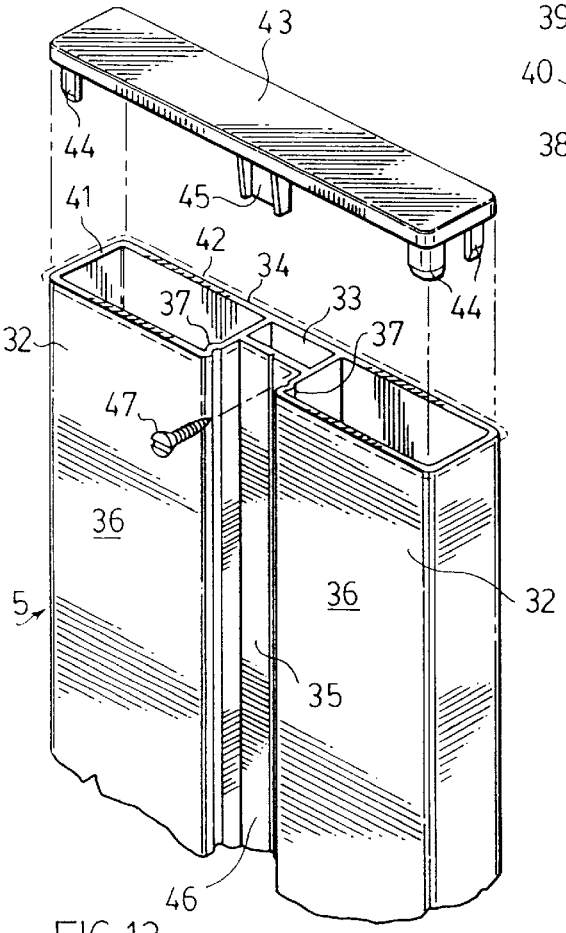
FIG.13.
FIG.14.
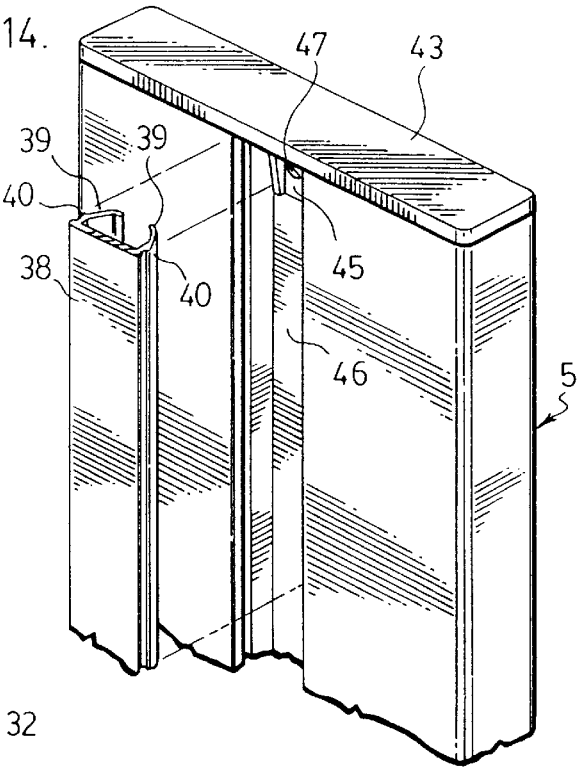
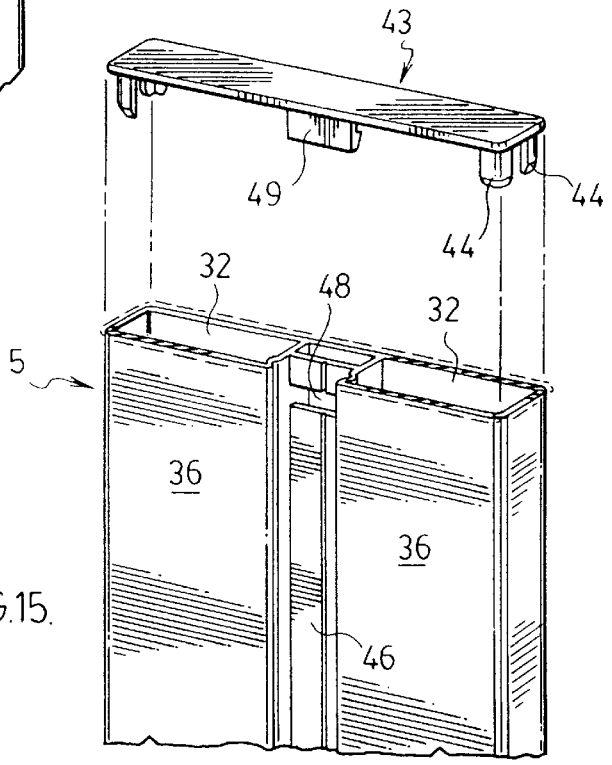
FIG.15.

75
71
75
73
73
74
74
74
74
74
78
78
78
77
77
77
72
80
79
80
72
80
9
9
9
9
2
6
6
6
6

75
70

74
72
72
6
6
2

85
81
82
82
81
83
84
85

PLASTIC FENCING AND COMPONENTS THEREFOR

FIELD OF THE INVENTION

This invention relates to plastic fencing and components therefor. More particularly, the invention relates to the provision of decorative or ornamental maintenance free fencing utilizing plastic components which can be easily and quickly erected using simple tools, will be strong and durable, impervious to rot, corrosion, insects, and weathering thereby maintaining its ascetic appearance indefinitely.

Further the invention relates to fencing as aforesaid which will enable the direction of the fence line to be readily changed over a wide range of angles.

Still further the invention relates to fencing as aforesaid which can be readily dismantled to replace individual members or entire fence sections without affecting adjoining sections.

BACKGROUND OF THE INVENTION

Plastic fences have been known for some considerable time but so far have not been widely accepted for various reasons including their lack of ascetic appeal, cost, difficulty of erection or disassembly, difficulty in replacing individual fence members such as the fence rails or removal or replacement of fence sections.

U.S. Pat. No. 3,554,494, granted Jan. 12, 1971, discloses an arrangement wherein the posts and rails are formed as rectangular hollow plastic extrusions with a series of internal compartments into which wood or metal reinforcing members can be inserted. The rails are secured to the faces of the posts by screws which remain exposed to provide a fence which lacks ascetic appeal.

Other plastic fencing involves slotting rectangular or square posts and inserting the ends of rail members into the post slots as shown by U.S. Pat. No. 3,955,801, granted May 11, 1976, U.S. Pat. No. 4,477,058, granted Oct. 16, 1984, U.S. Pat. No. 4,722,514, granted Feb. 2, 1988, and U.S. Pat. No. 5,161,783, granted Nov. 20, 1992. With such arrangements, erecting the fence is very awkward as either the posts cannot be set up first or have to be set up at very critical spacing to enable the juggling of the rail members into the slots, and either the rail members cannot be removed or cannot be removed without affecting adjoining sections of the fence and the fence sections can only extend from the slotted faces of the posts and are limited to inline fencing or fencing forming a right angle.

SUMMARY OF THE INVENTION

According to one aspect of the present invention, the fence rails are secured to a face of the posts inline with the post centers by a concealed connection that can be made after the posts have been installed and the rails can be disconnected from the posts without affecting the posts or the rails of any other section of the fencing.

In another aspect, the rail to post connections provide for effective rail length adjustments to accommodate inaccuracies in the spacing of the posts.

The posts according to the preferred form of the invention have an octagonal shape so that in addition to inline fencing adjoining fence sections can be oriented at angles of 45°, 90° and 135° either side of an inline position.

More particularly, according to the preferred form of the invention, the rail to post connection comprises an hanger fitted to a selected face of the post and a plastic bracket having a first end having a hood portion for overlying and concealing said hanger with means within said hood portion for interlockingly engaging with said hanger to secure said first end in abutting relation with the post, and a second end in the form of a sleeve to telescopically receive the rail end.

In accordance with another aspect of the invention, the vertical fence slats or pickets carried by the rails are attached thereto by concealed connections to enhance the ascetic appearance of the fence.

Furthe according to the invention, the rails and pickets are formed as hollow extrusions formed to accept reinforcing members such as metal channels and the like where desired for increasing strength and holding power for fasteners used to connect the fence members together.

In another aspect of the invention, the frame members are adapted to be extruded utilizing a core of reprocessed thermoplastic material having the exposed surfaces thereof covered with a protective cap stock to protect against weathering, impact and the like and to impart color if desired.

Still another aspect of the invention is the provision of top closures for closing the open upper ends of the posts and slats or pickets which can be easily and quickly mounted in place and positively secured against accidental removal.

In this connection, the invention further provides a novel cap for the octagonal posts formed of two identical mating half sections which mate together and snap lock with the top of the post.

These and other features and advantages will be apparent from the following detailed description taken in conjunction with the accompanying drawings.

BRIEF DESCRIPTION OF THE DRAWINGS

FIG. 4 is a perspective view looking down at the front of the rail support bracket.

FIG. 5 is a perspective view looking at the rear of the fence bracket from the underside of the bracket.

FIG. 6 is a sectional view on the line 6—6 of FIG. 5 of the bracket.

FIG. 13 is a broken away perspective view of a slightly modified form of slat showing it about to receive a flat closure or cap.

FIG. 14 is a view of the slat of FIG. 13 with the cap secured in place and the slat about to be closed to conceal the fastening means.

FIG. 15 is a view similar to FIG. 13 showing a slightly modified arrangement for fastening the cap or closure to the slat.

DETAILED DESCRIPTION ACCORDING TO THE PREFERRED EMBODIMENTS OF THE PRESENT INVENTION

Figure 1:
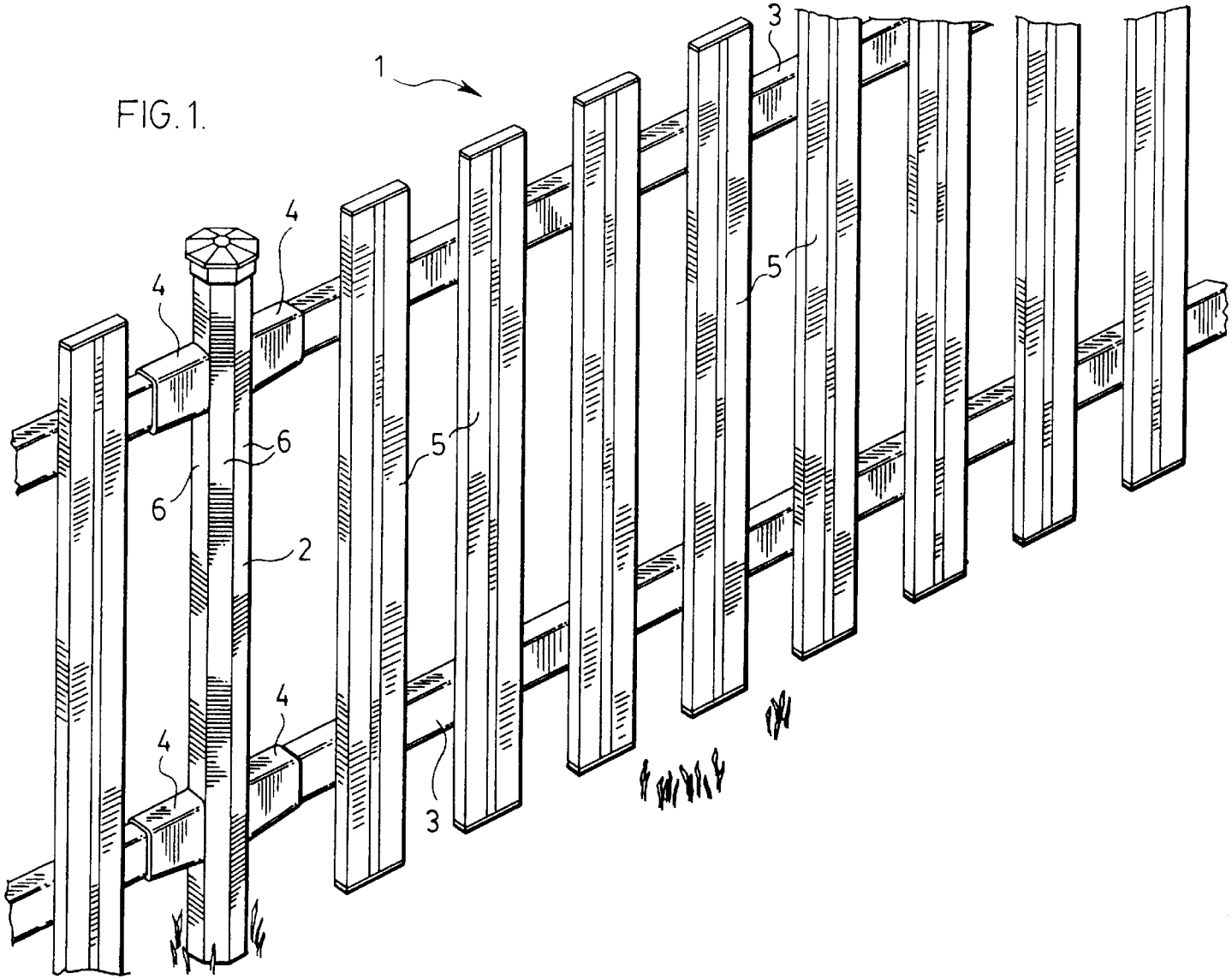
FIG. 1 is a broken away perspective view of a fence embodying the invention.

With reference to FIG. 1, the fence generally designated at 1 is erected from plastic members comprising posts 2, rails 3 supported from the posts by brackets 4, and uprights or slats 5 secured to the rails as hereinafter more fully described.

Although only one post is shown, it will be understood that posts will be set up at the requisite spacing for each fence section and the rails will have the appropriate length as hereinafter more fully described to span between the support brackets 4 carried by the posts.

Figure 2:
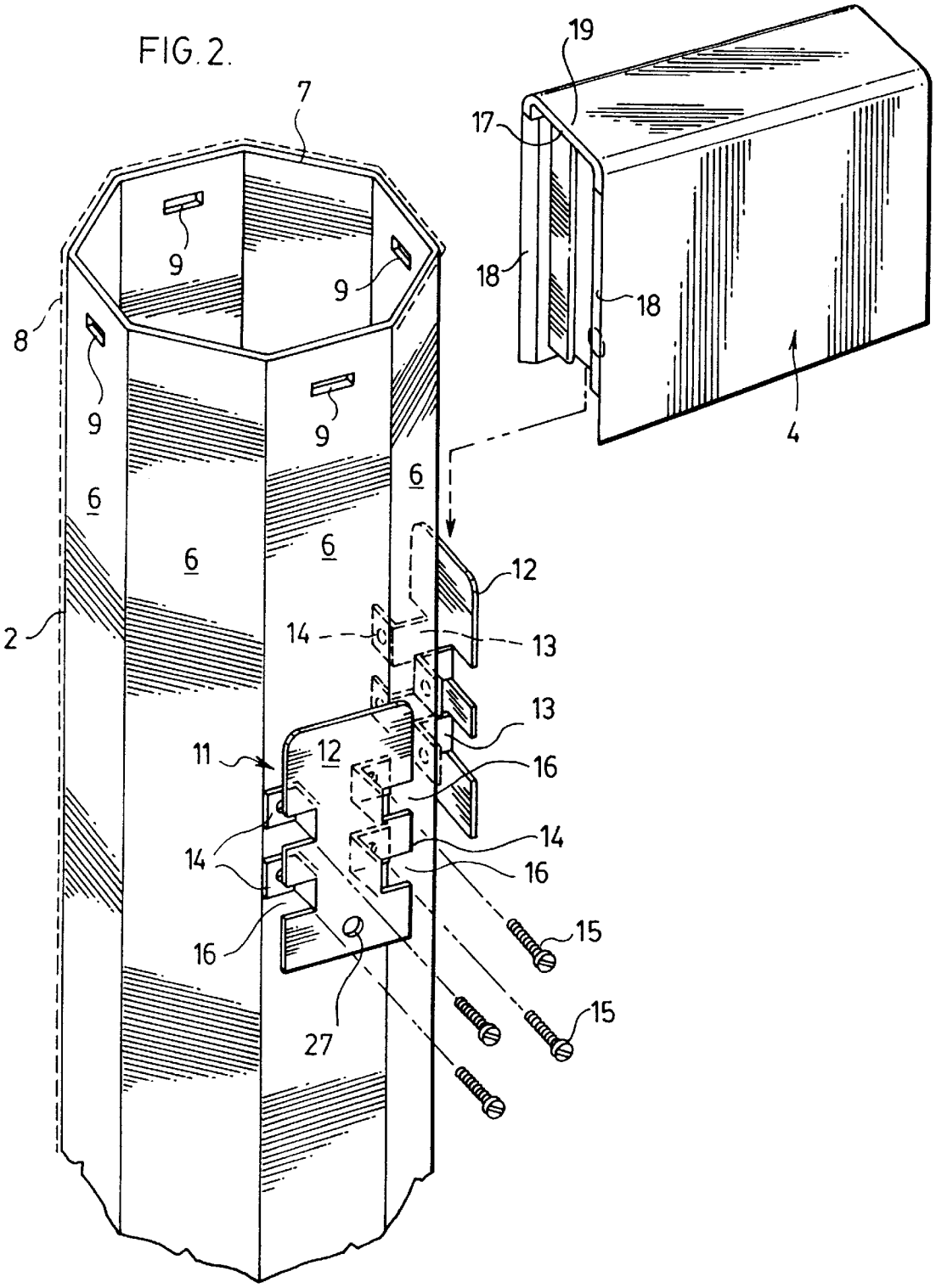
FIG. 2 is an exploded perspective view of a post fitted with hangers ready to receive a bracket member for connecting a fence rail to the post in a concealed connection.

As shown in FIG. 2, each of the posts 2 is hollow and in its preferred form is of octagonal cross section presenting eight flat exterior vertical mounting faces 6 so that the fence rails can be secured thereto at angles of 45° and multiples of 45° so that the rails of adjoining fence sections can be relatively oriented in eight different directions.

The posts 2 are preferably extruded to provide a polyvinyl core 7 coated on the exterior thereof by a protective cap stock designated by the dotted lines 8 containing suitable agents to protect against ultra violet radiation, provide impact resistance, coloring agents, and the like.

The cap stock also provides a smooth clean exterior surface to the post allowing the core 7 to be extruded utilizing material containing reprocessed thermoplastics.

Adjacent its top, the post 2 is provided with short horizontal slots 9 on the faces 6 which are in 90° relation. These slots are for the attachment of the post caps or closures such as the cap 10 shown in FIG. 1 as hereinafter more fully described.

As shown in FIG. 2, the means for securing each of the rail supporting brackets 4 comprises a hanger generally designated at 11 which is preferably formed of metal although it may be made of plastic, has a wide thin planar panel, plate or tongue portion 12 carried by legs 13 formed by material bent out of the plane of the plate 12 and extending at right angles thereto and terminating in outwardly turned mounting feet 14.

With this arrangement, each of the hangers 11 can be mounted to a selective one of the post faces 6 by suitable screws 15 to which access is afforded through the notches 16 formed in the plate 12 by the formation of the legs 13 and feet 14.

Adjacent its lower end, the plate 12 has a central raised locating boss 27.

When the hanger 11 is mounted to the face 6 of the post, the thin planar plate 12 stands proud of the post ready to have the rail supporting bracket 4 slid into engagement therewith for securing the bracket in butting relation with the respective post face 6.

As will be seen particularly in FIGS. 2 and 4, the forward end of the bracket 4 which is adapted to abut the face 6 of the post is in the form of a hood 17 open to the bottom of the bracket having side walls 18 and a top wall 19.

This hood portion 17 of the bracket extends rearwardly into the bracket to a partition wall 20.

Rearwardly of the partition wall the bracket is in the form of a sleeve 21 as will be seen from FIGS. 5 and 6 the sleeve being configured to the shape of the rails 3 with the mouth 22 of the sleeve being slightly larger than the dimensions of the rails so that an end of the rail can be telescopically received within the sleeve.

Provided within the hood portion 17 of the bracket is a pair of inwardly projecting legs 23 which define with the partition wall 20 spaced slots 24 which are adapted to receive the thin locking hanger plate 12 when the bracket 4 is slid down the post face 6 so that the plate 12 is secured between the legs 23 and partition wall 20 of the bracket with the forward edges 25 of the bracket which are preferably chamfered as at 26 in butting engagement with the post face.

The protruding plate boss 27 riding on the partition wall 20 as the bracket is being slid down the post face causes a tight friction fit between the plate and bracket causing a slight bowing of the plate outwardly between the opposing legs 23.

The partition wall 20 adjacent the bottom thereof is provided with a small indentation 28 adapted to receive the plate boss 27 when the bracket is slid fully home at which time the resiliency of the bracket plate 12 causes the plate boss 27 to snap into the recess 28 to indicate final location. The arrangement is such however that the rounded surfaces of the boss and recess 27 and 28 allow the bracket to be forced upwardly for removal with the boss camming out of the recess.

The bracket 4 is preferably made of a weatherable PVC containing appropriate ultra violet protecting agents and the like and may be colored if desired.

Figure 7:
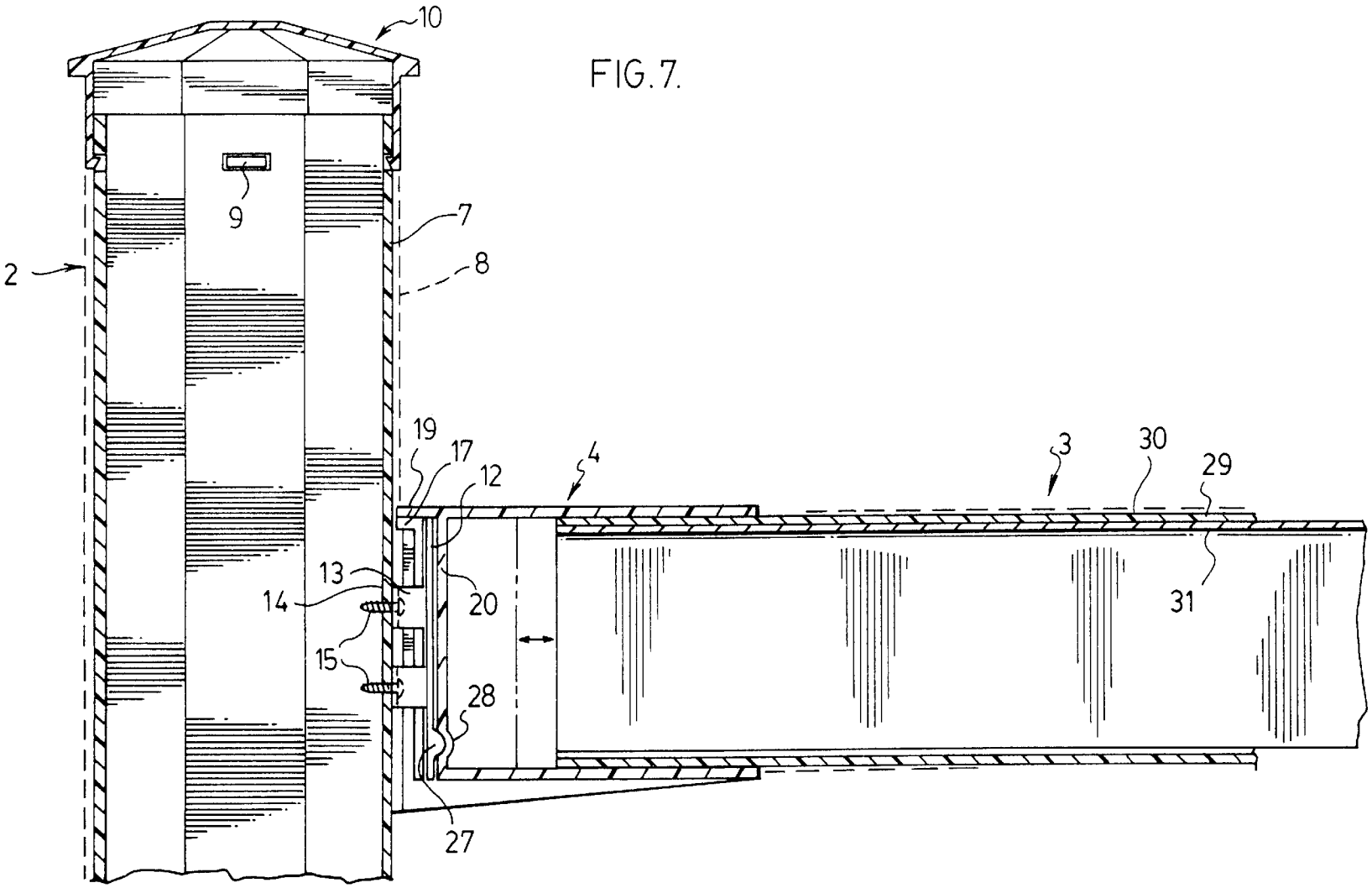
FIG. 7 is a broken away vertical sectional view illustrating the attachment of one of the rails to one of the posts via the post hanger and rail bracket.
Figure 8:
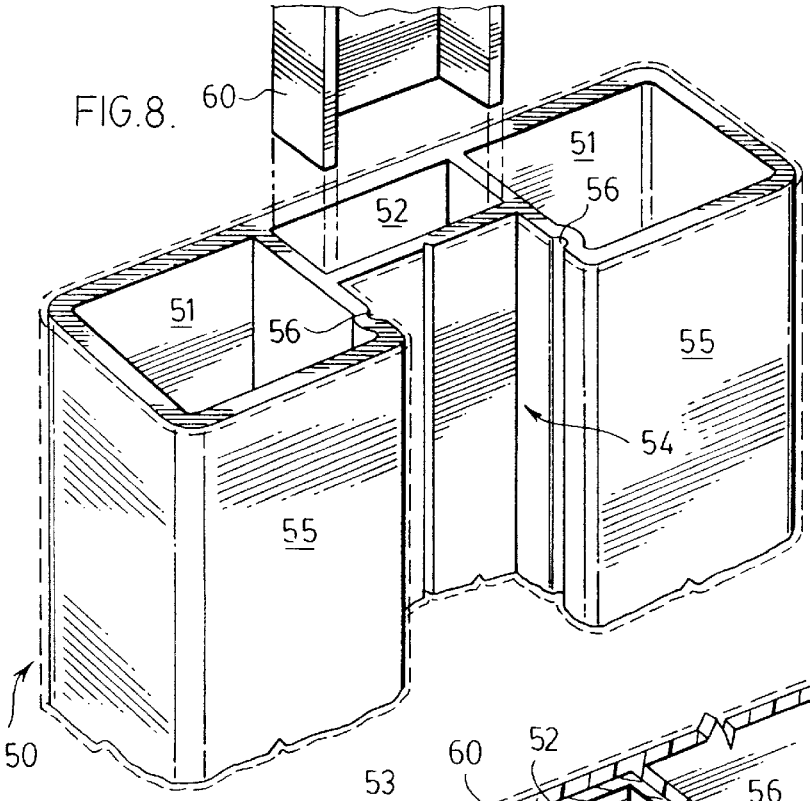
FIG. 8 is a broken away perspective view of one of the fence uprights or slats showing it about to receive a reinforcing channel insert.

It will be appreciated that the fence posts will be erected at the desired spacing and the hangers 11 secured to opposing fence post faces 6 and then the rails 3 will have each end telescoped into a bracket 4 as illustrated in FIG. 7 and the bracket slid down the post face 6 until it is fully home with the plate boss 27 seated in the bracket in the indentation 28. Because of the telescopic relation between the rail and the supporting brackets, it will be understood that the spacing of the posts does not have to be precisely accurate as the telescoped rail ends can adjust within the bracket sleeves 21.

As in the case of the posts, preferably the rails 3 comprise hollow co-extrusions of a PVC core 29 which may contain reprocessed plastic material and a cap stock indicated by the dotted lines 30. For strength the rails may contain a reinforcing insert such as the channel 31 shown in FIG. 3.

Figures 3, 18:
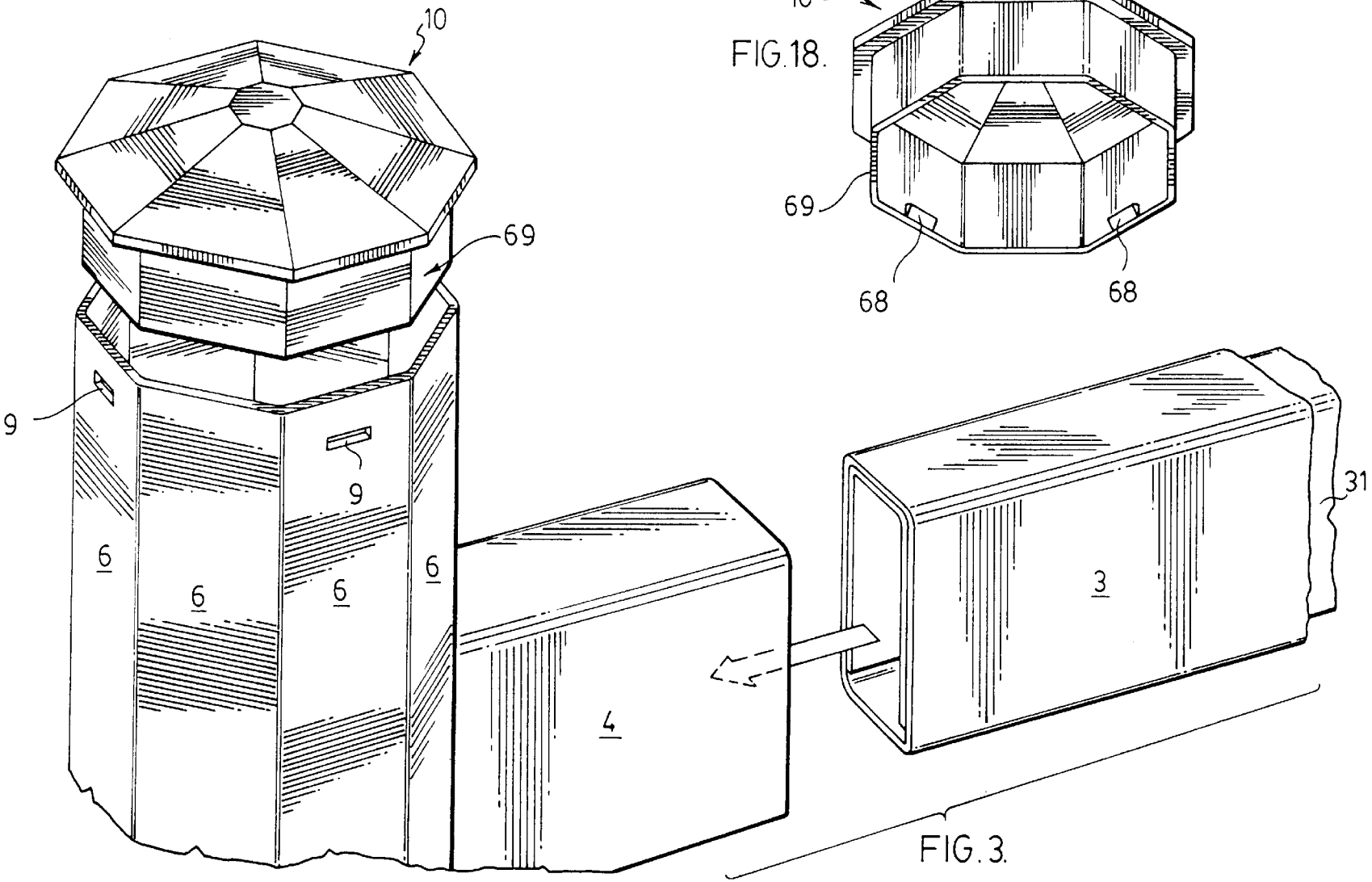
FIG. 3 is a broken away perspective view of a post with a rail bracket attached and showing the fence rail about to be inserted into the bracket with the post about to be capped.
FIG. 18 is a perspective view of the post closure or cap as shown in FIG. 3.

It will also be understood that in mounting the rails as illustrated in FIG. 3 the bracket 4 at one end may first be slid into secured butting relation with the post face and then one end of the rail with its reinforcing insert 31, where used, inserted into the sleeve portion 21 of the bracket. The other end of the rail may then be inserted into its respective bracket and the bracket at such other end slid into secured position with its respective hanger.

The uprights or slats 5 shown in FIG. 1 are illustrated in detail in FIGS. 13 and 14.

Each of these uprights comprises a longitudinal extrusion presenting two spaced main rectangular sleeve or tubular sections 32 joined by a smaller rectangular sleeve or tubular section 33 with the sleeve sections having a common rear wall 34 providing a channel 35 between the front faces 36 of the sleeve or tubular sections 32.

Grooves 37 provided adjacent the entrance of the channel 35 provide a locking means for a closure strip 38 shown in FIG. 14 provided with inturned legs 39 carrying projecting ribs 40 adapted to snap into the grooves 37.

Again these uprights or slats 5 are preferably a coextrusion of a core 41 of PVC material which may contain reprocessed plastic material and a cap stock indicated by the dotted line 42.

The central sleeve or tubular section 33 may contain a suitable reinforcing insert such as a steel or aluminum channel as desired.

The closure or cap 43 for closing the open upper end of the slat 5 is provided with depending guide legs 44 at the corners thereof adapted to fit snugly within the outer sleeve sections 32. The cap also has a central depending tongue 45 of channel form which is adapted to seat against the bottom wall 46 of the channel in position to receive a retaining screw 47 to secure the cap against dislodgement accidentally or through tampering.

It will be understood that the slat 5 will be secured to the rail 3 by fasteners (not shown) located within the front channel 35 so that when the closure strip 38 is snapped into position to close the channel it will hide both the retaining screw 47 and the fasteners used to secure the slat to the rails.

FIG. 15 shows the slat 5 with a slot 48 in the bottom wall 46 of the channel 35 to receive and interengage with a depending hooked leg 49 of a slightly modified cap 43' to retain the cap against accidental removal.

The upright or slat 50 shown in FIGS. 8 to 12 is similar to the slats 5 but of increased thickness for added strength.

Again the slat 50 has two main rectangular tubular or sleeved sections 51 spaced apart by a smaller or secondary rectangular tubular or sleeved section 52 having a common rear wall 53 providing a central channel 54 extending inwardly from the front faces 55 of the tubular or sleeved sections 51.

Figure 10:
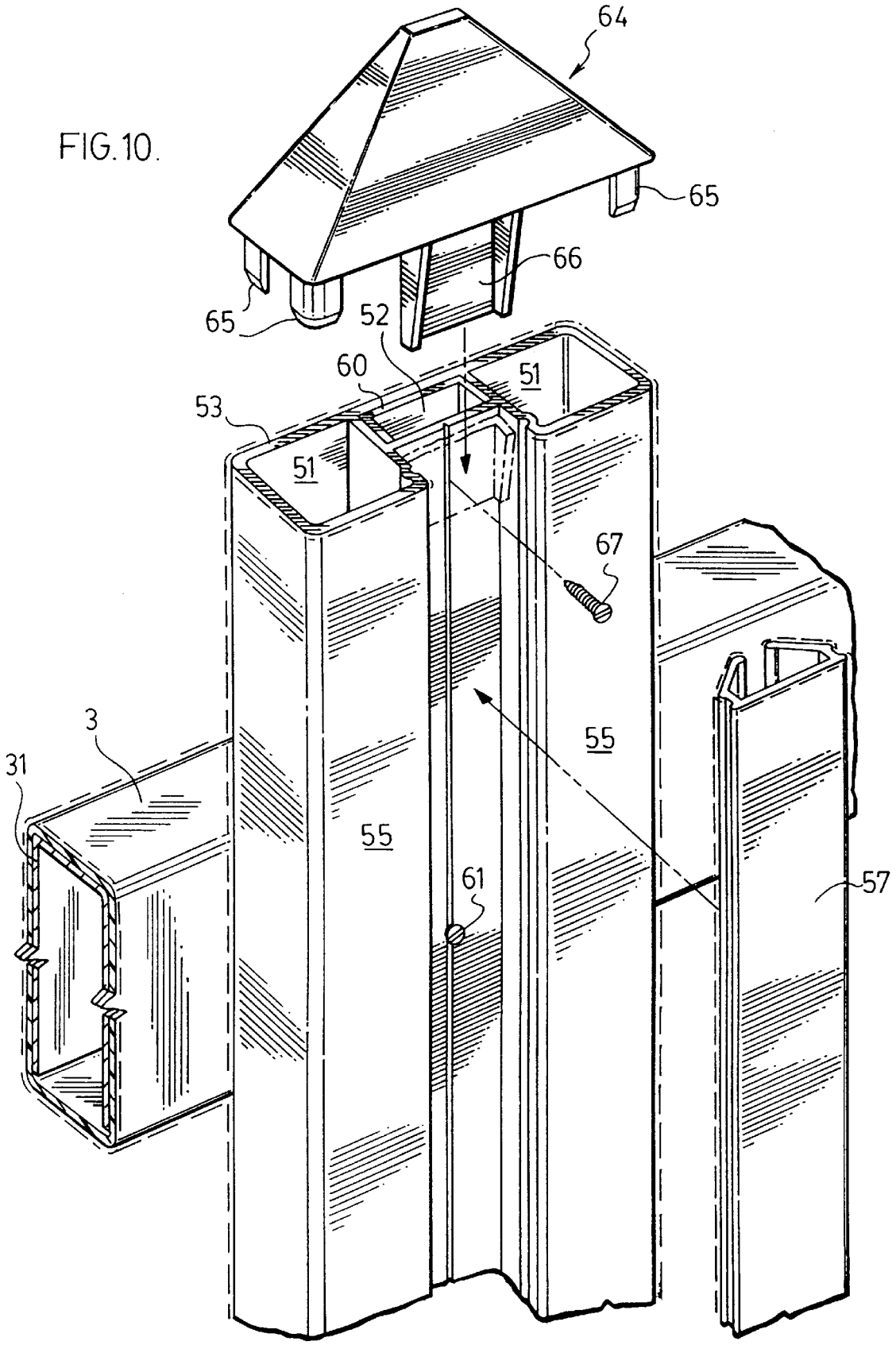
FIG. 10 is a view similar to FIG. 9 but showing the slat about the receive a closure cap giving the slat a pointed picket appearance and about to receive a closure to conceal the fastening means.
Figure 12:
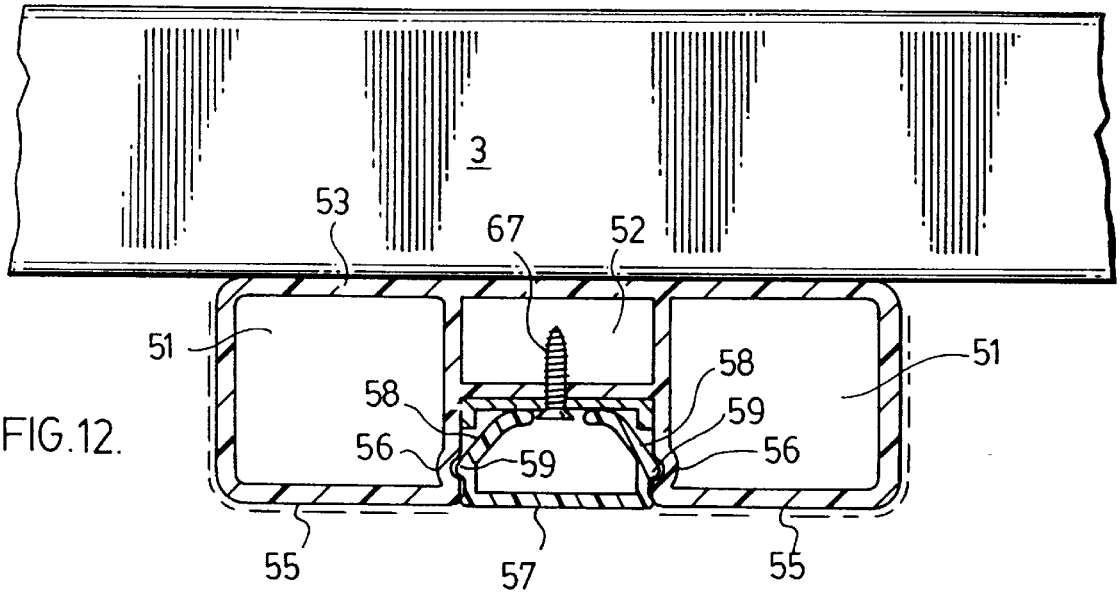
FIG. 12 is a plan view of the slat and rail indicating how the depending portion of the cap shown in section is secured to the slat.
Figure 11:
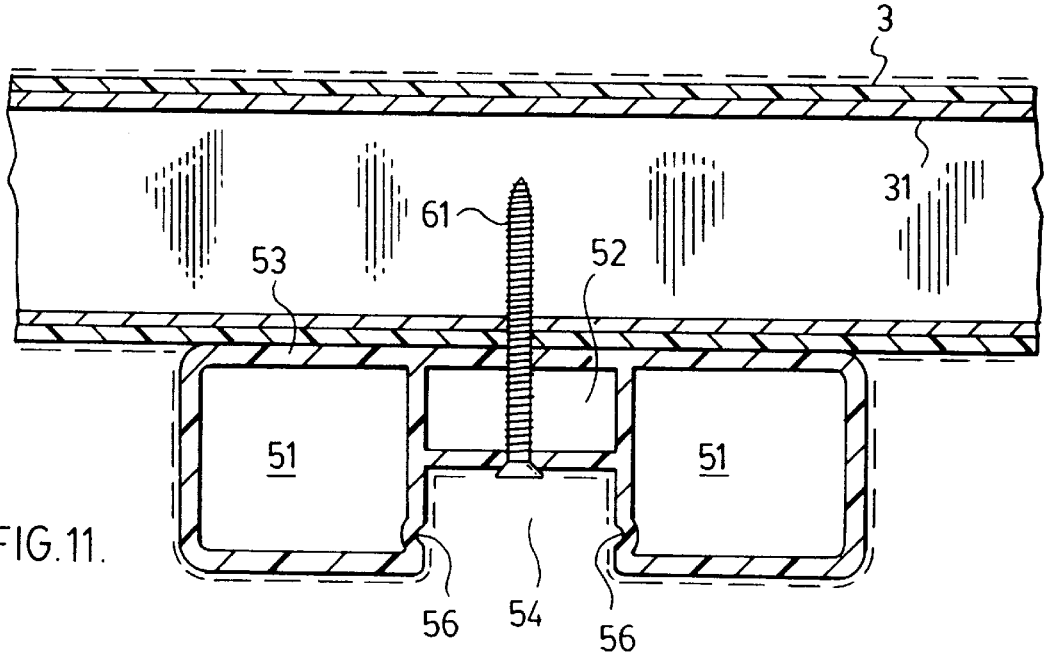
FIG. 11 is a horizontal sectional view showing the slat connected to the rail.

Adjacent the entrance to the channel 54 are grooves 56 for securing a closure strip 57 as shown in FIGS. 10 and 12 which is provided with inturned legs 58 having ribs 59 adapted to snap into the grooves 56.

Figure 9:
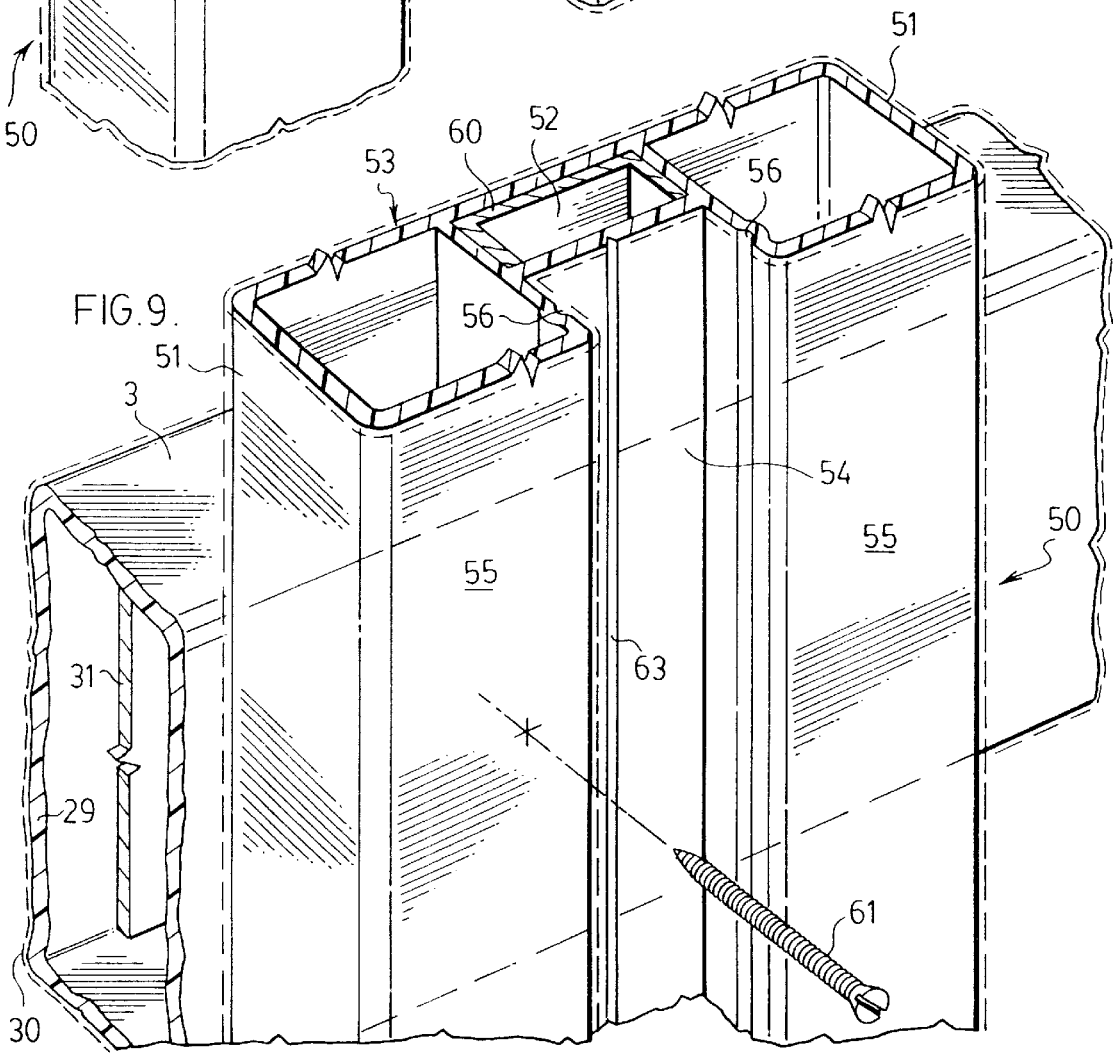
FIG. 9 is a perspective view of the slat of FIG. 8 about to be secured to one of the fence rails.

The secondary or central tubular section 52 of the slat 50 is adapted to receive a reinforcing insert such as the channel 60 of suitable material such as aluminum or steel to assist in the holding power of the fasteners or screws such as illustrated at 61 in FIG. 9 which secure the upright or slat to the rail 3 the screw penetrating the reinforcing insert 60 of the slat as well as the plastic of the slat, the plastic of the rail 3, and the reinforcing insert 31 of the rail where used.

To assist in locating the position of the screw 61, the bottom wall 62 of the channel 54 is shown provided with a central guide groove 63.

While FIGS. 13 to 15 showed the use of a flat closure or cap 43, 43', FIG. 10 illustrates a cap or closure 64 in the form of a narrow truncated pyramid to give the fence slat or upright the appearance of a pointed picket.

Again, the cap or closure 64 has depending locating legs 65 at the corners thereof to fit down into the main sleeve sections 51 with a snug fit to orient the cap and a channel shaped depending tongue portion 66 adapted to abut the bottom wall 62 of the channel 54 to be secured thereto by a fastener or screw 67. Again, after securement of the upright to the fence rails and attachment of the cap 64, the closure strip 57 is snapped into position to hide the fasteners 61 and 67.

As in the case of the uprights or slats 5, the uprights or slats 50 are preferably a coextrusion as discussed with respect to slats 5.

The post cap or top closure 10 shown in FIGS. 1, 3 and 7 is particularly illustrated in FIG. 18 which shows the short inwardly projecting teeth 68 located adjacent the bottom of the hexagonal wall 69 in 90° spaced relation so that when the hexagonal wall 69 of the cap is fitted down over the upper end of the post 2 with the locking teeth 68 registering with the post slots 9 these teeth will snap into and interlock with the post slots as illustrated in FIG. 7.

Figures 16, 17:
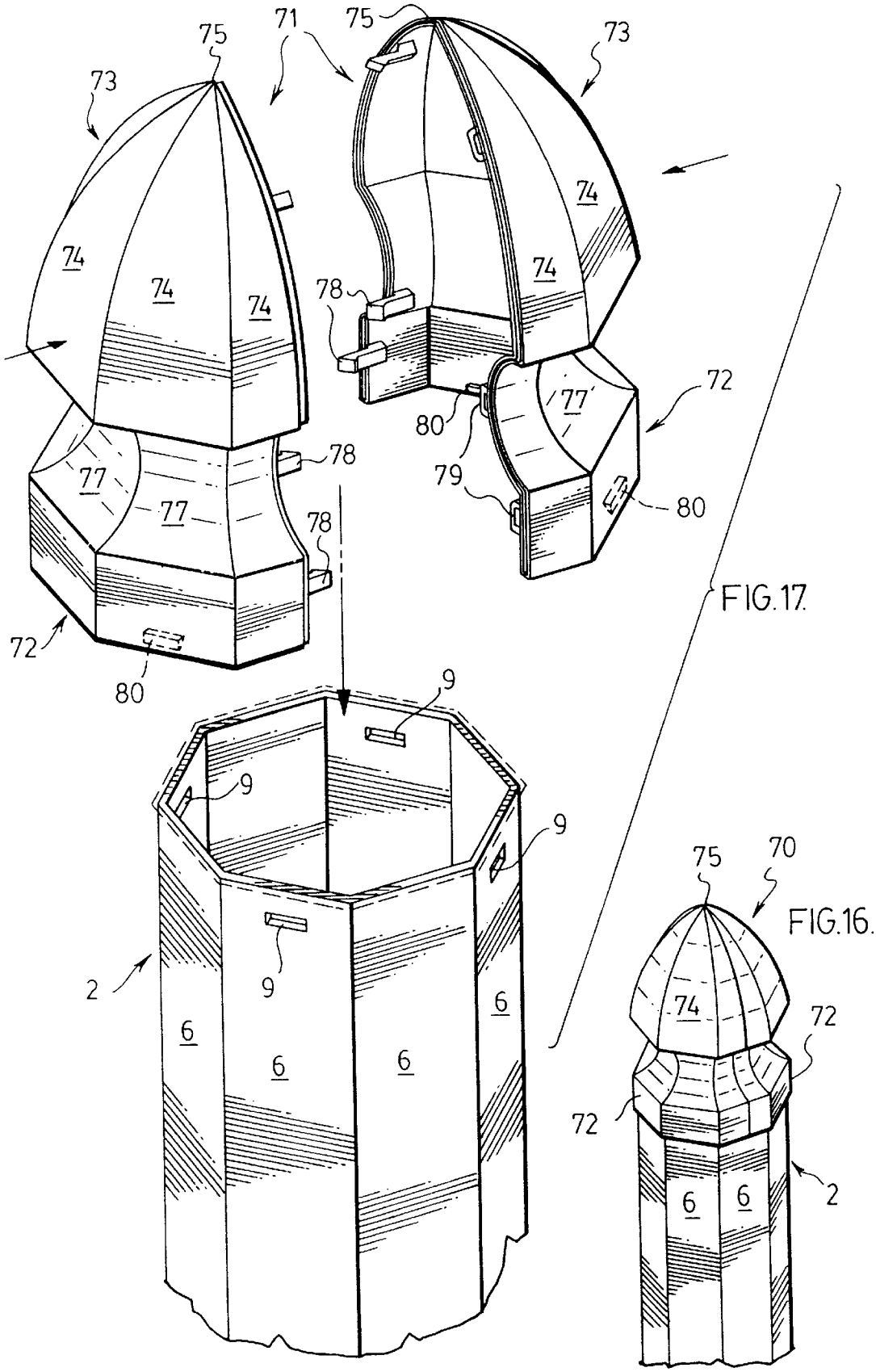
FIG. 16 is a broken away perspective view of a post having a decorative cap or closure.
FIG. 17 is an enlarged exploded perspective view of the upper end of the post and cap with the cap half sections about to be connected prior to snap fitting over the upper end of the post.
Figure 19:
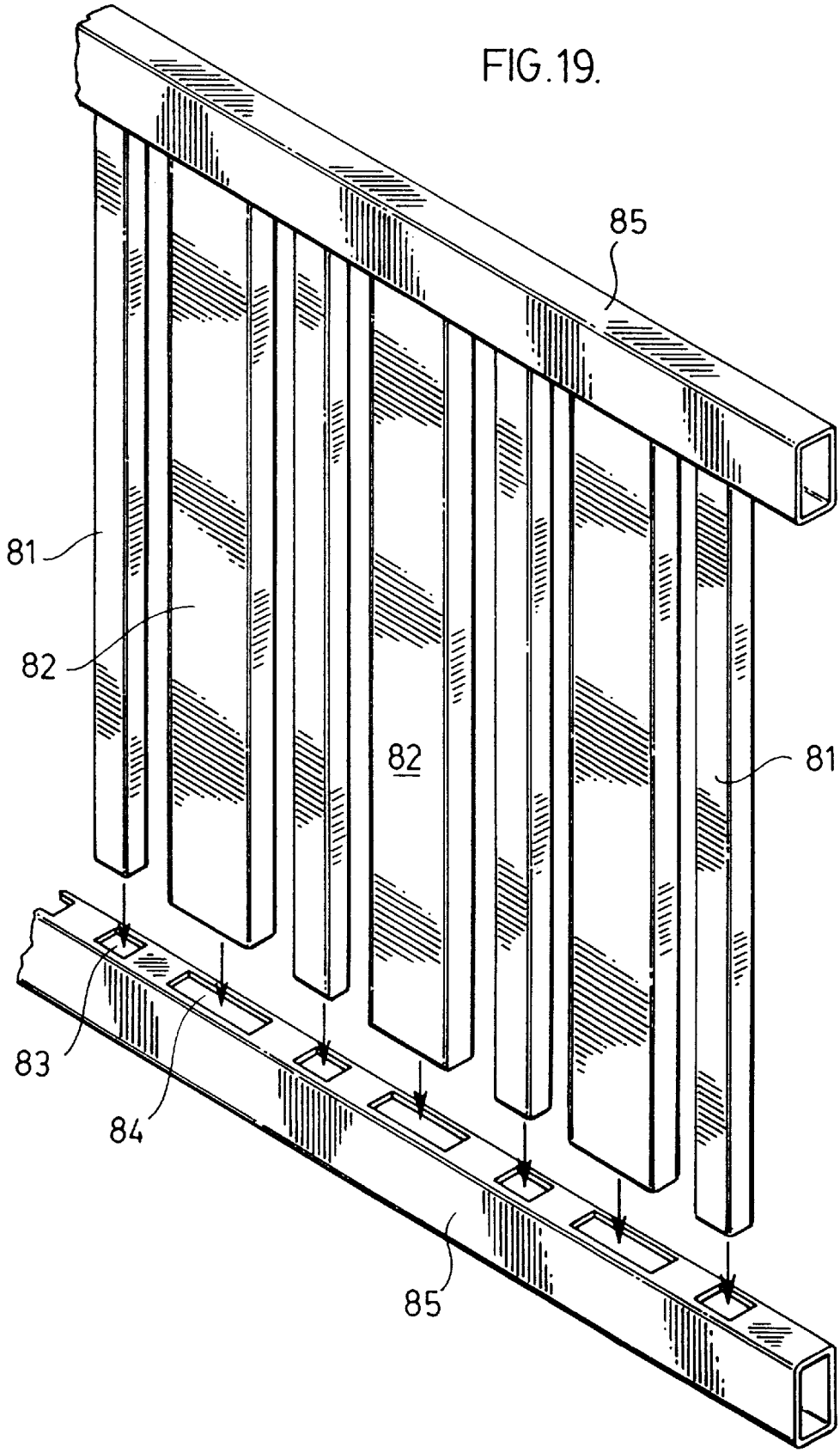
FIG. 19 is a broken away perspective view of an alternative arrangement of rails and slats in which the slats are in line with and inserted into the rails.

FIGS. 16 and 17 illustrate an alternative decorative cap or closure 70 for closing the upper end of the post 2.

In this case, the cap or closure comprises two identical half sections 71 each having a half hexagonal base wall 72 supporting a half of an eight sided pointed or spear head dome portion 73 having arcuate wall segments 74 arching upwardly and inwardly to a top point 75 from a half hexagonal base 76 connected to the base 72 by inwardly arched walls 77.

Each of the half sections 71 is provided internally on one side with projecting locking legs 78 and on the other side with locking leg receiving loops 79 so that when the identical half sections are arranged in face to face relation as illustrated in FIG. 17 the locking legs 78 will register with the locking loop 79 allowing the two half sections to be snapped together to complete the cap or closure 70.

The cap in its fastened condition can then be placed down over the top of the post 2 again being provided with locking teeth 80 adjacent the bottom of the base wall 72 to snap into the post slots 9.

FIG. 18 illustrates a modified form of rail and slat arrangement wherein the slats 81 and 82 are inserted into slots 83 and 84 respectively in the rails 85 so that the slats or uprights are located centrally of the rails.

The slats and rails are formed of suitable extrusions as aforesaid and it will be understood that the rails will be connected to the posts in the same manner as described with respect to the rails 3 and illustrated in FIGS. 2, 3 and 7.

In all instances, provision is made so that no fasteners connecting the uprights to the rails are exposed and the connection between the rails and the posts are concealed.

With the provision of the hexagonal posts, the rails can be oriented in eight different directions in 45° angle increments so that the fencing is not restricted to simple inline fences or fences at right angles.

In addition, a fence section may readily be removed by sliding the rail supporting brackets 4 upwardly to clear the hangers 11 without in any way affecting adjoining fence sections. The ability to remove fence sections to allow, for example, the passage of a vehicle into the fenced area provides an important benefit. Also, of course, the individual uprights or slats 5 and 50 can be quickly individually removed and replaced as required.

With the fence structure shown in FIG. 18, it will be understood that the rails 85 can be readily disconnected from the posts for replacement of the slats 81 and 82 or replacement of the rails themselves.

Because of the hollow construction of the rails and slats, they are all capable of taking inserts in the form of metal tubes or channels or other shaped inserts wherever desired. It will also be understood that, while the invention in its preferred form employs hexagonal posts 2, the rail to post connection afforded by the brackets 4 and hangers 11 is applicable to posts of other cross section.

It will be understood that various other modifications may be made to the fence components without departing from the spirit of the appended claims.

The embodiments of the invention in which an exclusive property or privilege is claimed as follows.

1. A fence structure comprising spaced hollow plastic posts, vertically spaced hollow plastic rails extending between said posts, and connector means connecting the ends of said rails to said posts in a concealed connection, each connector means comprising a first connector member secured to and standing proud of the post to be connected and a second connector member having a first end to slidably receive and conceal said first connector member and a second end in the form of a sleeve to receive and support the rail end to be connected to the post and means within said first end for interlockingly engaging with said first connector member.

2. A fence structure comprising spaced hollow plastic posts presenting a plurality of flat vertical faces around the perimeter thereof, vertically spaced hollow plastic rails extending between said posts, and connector means connecting the ends of said rails to a vertical face of said posts in a concealed connection, each connector means comprising a first connector member secured to the said vertical face of the post to be connected and a second connector member having a first end formed with a hood to overlie and conceal said first connector member and having means within said hood to interlockingly engage said first connector member and a second end in the form of a sleeve to receive and support the end of the rail to be connected.

3. A fence structure as claimed in claims 1 or 2 in which the interlocking connection between said first connector means and said second connector means is a vertically slidable connection.

4. A fence structure comprising spaced hollow plastic posts presenting a plurality of flat vertical faces around the perimeter thereof with adjacent posts presenting selected ones of said flat faces in opposing relation, vertically spaced hollow plastic rails extending between adjoining posts and connector means for connecting said rails to said opposing flat surfaces, each said connector means comprising a hanger member secured to the respective flat post surface, a plastic bracket member having a hooded portion formed to fit over and conceal said hanger member and interlock therewith with said hooded portion in abutting relation with the respective post flat face and a sleeve portion to telescopically receive the end of the rail being connected to the post.

5. A fence as claimed in claim 4 in which said posts have an octagonal cross-section.

6. A fence as claimed in claims 4 or 5 in which said rails contain reinforcing channel inserts.

7. A fence structure as claimed in claim 4 or 5 having a plurality of spaced vertical slats between said posts, means connecting said slats to said rails and means concealing said connections.

8. A fence comprising a plurality of hollow extruded thermoplastic posts, a plurality of hollow extruded thermoplastic rails extending between said posts and a plurality of vertical fence members secured to said rails, each said vertical fence member comprising an extrusion of thermoplastic material having a planar rear wall, two spaced tubular rectangular main chambers extending forwardly from said rear wall and defining the thickness of said member and a second tubular rectangular chamber smaller than and located between said main chambers and extending forwardly from said rear wall to a point intermediate the thickness of said member and defining a channel between said main chambers opening to the front of said member, fastening means inserted into said channel of each said member to secure same to its respective rails and a closure member for each said channel, said closure member and channel having interengaging locking means to secure said closure member in channel closing relation.

9. A fence as claimed in claim 8 in which said vertical fence members have reinforcing inserts in said secondary chambers and said fence rails have reinforcing inserts therein.

10. A fence as claimed in claim 9 in which said reinforcing inserts are metal members selected from metal channels and tubes.

11. A fence as claimed in claims 8, 9 or 10 in which said extruded thermoplastic posts, rails and vertical members are extruded to provide a core containing reprocessed thermoplastic material and a protective co-extruded cap stock covering exposed exterior surfaces thereof.

12. A connector as claimed in claim 11 in which said tongue and bracket first end portion have co-operative final locating means to indicate when said tongue edges are fully home in said internal grooves.

13. Connector means for connecting a fence rail to a fence post comprising a hanger member having mounting means for attachment to the post, said mounting means supporting a planar tongue spaced away from said mounting means and having spaced groove engaging edges, and a plastic bracket member having a first end portion to fit over and conceal said hanger member and having spaced internal grooves to receive and interlock with said spaced tongue edges, and a second tubular end portion to receive the ends of a fence rail.

14. A fence vertical member comprising an extrusion of thermoplastic material having a planar rear wall for attachment to the rails of a fence, two spaced tubular rectangular main chambers extending forwardly from said rear wall and defining the thickness and presenting spaced outer faces of said member and a secondary tubular rectangular chamber smaller than and located between said main chambers and extending forwardly from said rear wall to a point intermediate the thickness of said member and defining a channel for receiving fasteners for securing said member to the rails of a fence between said main chambers at the front of said member, and a fastener concealing closure for said channel, said closure and channel having interengaging means to secure said closure in channel closing position, said closure being formed to bridge between and lie flush with said spaced outer faces of said main chambers.

15. A cap for attachment to the top of a fence post comprising a mounting base and a closed ornamental top, said cap comprising two identical half sections each having identical sets of male and female interlocking elements at the periphery thereof which when the half sections are oriented to face each other interengage to secure the sections together, said base having means to interlock with the top of a post with said half sections interlocked together.

* * * * *